United States Patent [19]

Huang

[11] 4,224,701

[45] Sep. 30, 1980

[54] PEST AND ODOR PREVENTIVE SANITARY DRAINER

[76] Inventor: Ching-Piao Huang, No. 1, Tung-Ming St., Hsin Chu, Taiwan

[21] Appl. No.: 948,488

[22] Filed: Oct. 4, 1978

[51] Int. Cl.[3] ..... E03C 1/26

[52] U.S. Cl. ..... 4/206; 4/294; 4/191; 4/286; 4/222

[58] Field of Search ..... 4/206, 207, 294, 293, 4/222, DIG. 19, 1, 191, 286

[56] References Cited

U.S. PATENT DOCUMENTS

| | | | |
|---|---|---|---|
| 1,916,357 | 7/1933 | Brownstein | 4/221.1 |
| 2,020,864 | 11/1935 | Aronson et al. | 4/294 |
| 3,651,826 | 3/1972 | Kojima | 4/206 |
| 3,751,734 | 8/1973 | Lumadue | 4/206 |

*Primary Examiner*—Lenard A. Footland

*Attorney, Agent, or Firm*—Blair, Brown & Kreten

[57] ABSTRACT

Disclosed herein is a pest and odor preventive sanitary drain which utilizes the continuous property of liquids and permits a twisting downward discharge of waste water and keeps a certain waste water retention level in the water holder therebeneath so that the inlet of the discharge pipe is obstructed; in addition, a deodorizer is used for complete prevention of odor and pests towards a house so that indoor sanitation is maintained and human health is protected.

3 Claims, 6 Drawing Figures

PEST AND ODOR PREVENTIVE SANITARY DRAINER

BACKGROUND OF THE INVENTION

FIELD OF THE INVENTION

Our health, in addition to the living and food conditions as well as adequate exercise, depends on the cleanliness and sanitation of the environment. However, our traditional water drain used both indoors, outdoors, in the kitchen, toilet and bathroom comprises only a short pipe and a filter. It is of simple construction but cleaning is difficult. After a certain period, it can be a reproduction nest for mosquitoes, flies, mantis etc. Then, disease brought by mosquitoes, flies, mantis, rats etc. and the odor from the drainage will attack the interior of a house through the drainage piping and discharge ports. In consequence, there will be a great harm to the human health. As a solution of the above problem, a U-pipe or S-pipe has been installed beneath the discharge port so that attack of odor and pest alike can be prevented by the retained waste water in such a pipe. However, such a pipe is of high production cost, requires difficult installation, and frequently springs a leak as well as retains spoiled material. Therefore, the problem of odor prevention has not been effectively resolved. Furthermore, which is the most important disadvantage, such a pipe is only suitable for a suspension basin rather than for underground installation. In consideration of the abovementioned disadvantages, an effective measure is provided herein as an exact solution for such longstanding disadvantages.

SUMMARY OF THE INVENTION

An object of the invention is to improve the drain currently used in the ordinary household, such as a toilet, bathroom, basin, etc. so that pest and odor from the exterior or in the drainage piping will never attack a house and thus environmental cleanliness will be maintained and human health will be protected.

In addition to the abovementioned merits, the invention is easily installed. It is also washable and exactly a deodorant device.

The invention can replace any existing installation by removing the latter directly without damaging much of the existing installation. It consists of a water holder which is to replace the original drainage installation. Under the water holder a drainage pipe is connected and on the top there is an ordinary filter. There is one or more overflow lips on the water holder. A definite quantity of water is always retained in the water holder. Once there is a drainage, the excessive waste water will discharge from the overflow lip. The waste water retained in the water holder will form a retention surface. And then, a cover sinks half-way downwards (i.e. suspends in water). The cover could be a cover or funnel with a sealed flange, so that one or more water area is formed between the edges of the wall and the edges of the overflow lip. Such water area is the necessary way for waste water during draining, which is also the necessary path of a pest in attacking a house. Since a maximum retention surface is always maintained in the water holder, the waste water held there obstructs the inlet for pests but allows zigzag discharge of waste water. Therefore, the discharge of water is smooth at all times.

In addition, some deodorant is placed above the water holder to eliminate odor generated in drainage pipe. Indeed, it is an ideal construction.

DETAILED DESCRIPTION OF PREFERRED EMBODIMENT

The invention permits a zigzag downward discharge of waste water so that a definite amount of water is always retained in the water holder therebeneath and the inlet of the discharge pipe is completely obstructed. Furthermore, a deodorant is used for complete prevention from the attack of pests and odor so that indoors cleanliness is maintained at all times and human health is protected.

Detailed description is hereby given with reference to the applicable examples as shown on the attached drawings.

Figure 1:
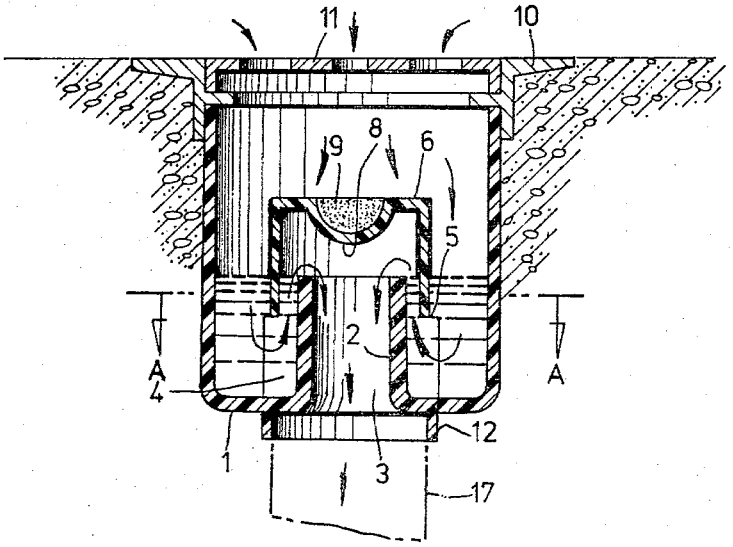
FIG. 1 is a sectional view of the first applicable example of the invention. It shows the retention of waste water and the direction of flow.
Figure 2:
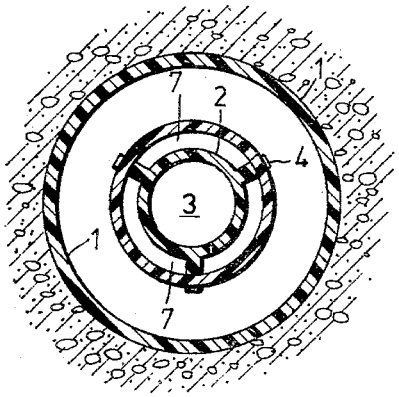
FIG. 2 is a sectional view of the cut line A—A in FIG. 1. The space between the flange and cover is clearly shown.
Figure 3:
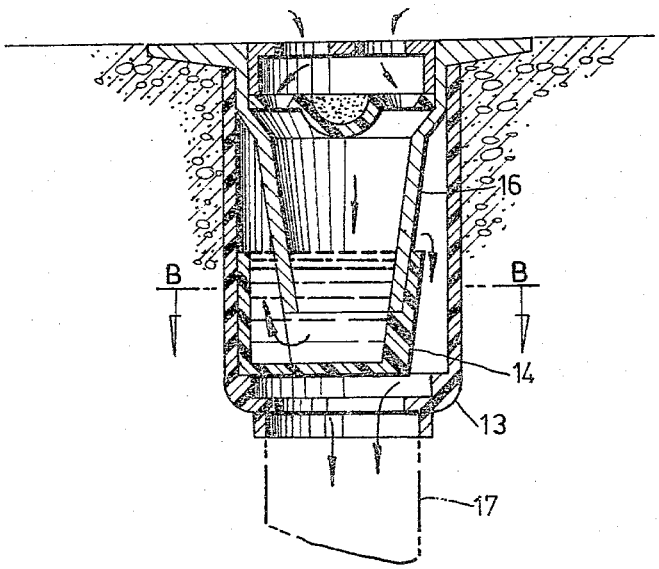
FIG. 3 is a sectional view of a second embodiment. The figure shows the retention of waste water and the direction of flow, and corresponds to section C—C of FIG. 4.
Figure 4:
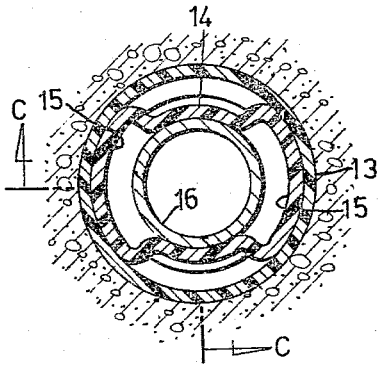
FIG. 4 is a sectional view of the cut line B—B in FIG. 3. It shows the connection between water holder and funnel.

FIG. 1 and FIG. 2 indicate the first applicable example of the invention; FIG. 3 and FIG. 4 show the second applicable example of the invention while FIG. 5 and FIG. 6 refer to the third applicable example. In FIG. 1 and FIG. 2, there is a water holder 1; from the bottom of the holder, there is an upward flange 2. An overflow lip 3 is designed on the flange 2 for waste water overflowing. Around the flange 3 there are three support ribs 4. A shoulder 5 is designed on each support rib 4 for placing a cover 6. Because of the presence of support ribs 4, several spaces 7 are found between the cover 6 and flange 2 (as shown on FIG. 2). When draining water, the water level rises and then the water flows over flange 2. At the center of the top of cover 6, a socket 8 is designed for holding deodorant 9 so that the odor therein is eliminated. In addition, a flange cover 10 is placed on the top flange of water holder 1. Above the flange cover 10 a filter is placed. Furthermore, there is a flange 12 beneath the water holder 2 for pipe connection. During the discharge of water, water is discharged in the arrow's direction and the flow is smooth. Therefore, it is suitable for indoor and kitchen drainage. Food and rice residues from the filter are forcefully flowed away rather than retained there.

FIG. 3 and FIG. 4 show another embodiment of the invention. FIG. 3 is the sectional view of line C—C in FIG. 4 while FIG. 4 is the sectional view of line B—B in FIG. 3. Its characteristics are identical to that in the first applicable example. It consists of a water cup 13. A water drum 14 is installed near the bottom of the cup. The cross-sectional view of such a water drum 14 is shown in FIG. 4. There are two projections on the drum 14 for water cup 13 insertion. Funnel 16 is inserted into the water drum 14. Therefore, there is a continuous flowing path between the funnel 16 and projections 15 and between water drum 14 and water cup 13. Other members are identical to that in the first applicable example and their description is omitted. During the discharge of water, water flow off follows the arrow direction. Such an example is preferably used in basins and baths.

Figure 5:
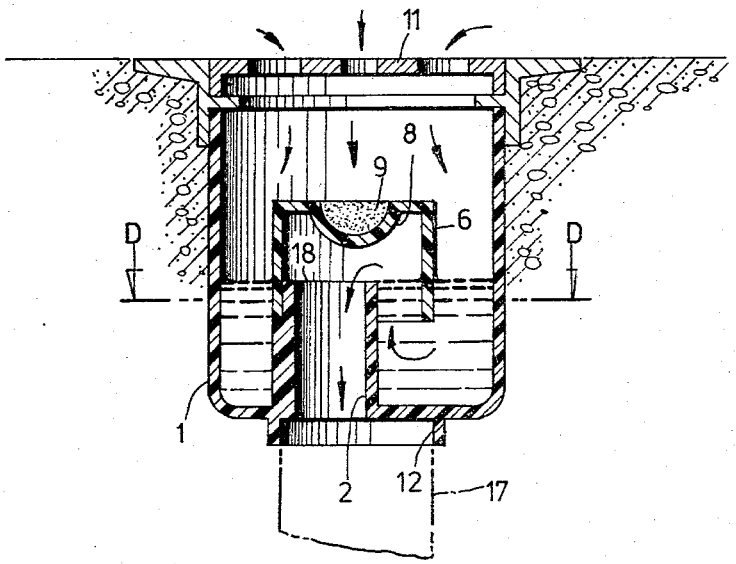
FIG. 5 is a sectional view of the third applicable example. It shows the retention of waste water and the direction of flow.
Figure 6:
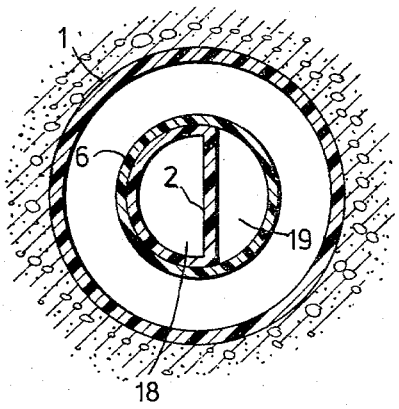
FIG. 6 is a sectional view of the cut line D—D in FIG. 5. It shows the water flowing direction.

The overflow lip 18 shown in FIG. 5 and FIG. 6 is of slightly semicircular shape. Water flows off by means of the other semicircular space through the overflow lip 18. Such example is also preferably used for indoor and kitchen drainage.

In conclusion, retention of water in a definite quantity is applied in both the water holder 1 or water drum 13 for obstruction of the water pipe, and the pest will be drowned or stopped there. Therefore, mosquitoes and other pests will never be able to enter the house. Further, the deodorant will eliminate all the odor therein. Since all members are movable and washable, reproduction of pests and release of odor are absolutely prevented. Thus, the major object of the invention, protection of human health, is achieved.

I claim:

1. A drain insert which prevents odor and pests from entering with a living area comprising:

a water cup (13) having a top portion countersunk below a bottom surface of a sink or the like and disposed within a drainage hole of the sink, and having a bottom portion provided with an annular flange (12) for connection with a drainage pipe, a cover nested on said top portion of said water cup having a plurality of openings for passage of water therethrough, said cover having a funnel extending downwardly within said water cup, and a water drum (14) carried on a lower rim portion of said water cup above said flange (12) so that said funnel extends therewithin and said water drum is offset relative to longitudinal axis of said water cup whereby water from the sink is funneled into said water drum which when overfilled passes into the drain pipe over said water drum.

2. The device of claim 1 further including deodorizing dispensing means disposed above a retained water level so as to inhibit odors from the drain.

3. The device of claim 2 in which said funnel supports said deodorizing means which is defined by an apertured plate extending across said funnel having a socket thereon for the disposition of a deodorant.

* * * * *